United States Patent [19]

Roller et al.

[11] Patent Number: 4,627,605

[45] Date of Patent: Dec. 9, 1986

[54] FRONT AIR KNIFE TOP VACUUM CORRUGATION FEEDER

[75] Inventors: George J. Roller, Penfield; Kendolph A. Thomas, Rochester, both of N.Y.

[73] Assignee: Xerox Corporation, Stamford, Conn.

[21] Appl. No.: 795,593

[22] Filed: Nov. 6, 1985

[51] Int. Cl.[4] ..... B65H 3/12

[52] U.S. Cl. ..... 271/94; 271/24; 271/34; 271/98; 271/161

[58] Field of Search ..... 271/34, 94–96, 271/98, 24, 161

[56] References Cited

U.S. PATENT DOCUMENTS

| | | | |
|---|---|---|---|
| 868,317 | 10/1907 | Allen . | |
| 1,721,608 | 7/1929 | Swart et al. . | |
| 1,867,038 | 7/1932 | Upham . | |
| 2,224,802 | 12/1940 | Spiess . | |
| 2,895,552 | 7/1959 | Pomper et al. | 164/68 |
| 2,979,329 | 4/1961 | Cunningham | 271/29 |
| 3,041,067 | 6/1962 | Fux et al. | 271/57 |
| 3,086,771 | 4/1963 | Goin et al. | 271/31 |
| 3,171,647 | 3/1965 | Bishop | 271/11 |
| 3,182,998 | 5/1965 | Peterson | 271/74 |
| 3,260,520 | 7/1966 | Sugden | 271/26 |
| 3,424,453 | 1/1969 | Halbert | 271/35 |
| 3,614,089 | 10/1971 | Van Auken et al. | 271/26 R |
| 3,770,266 | 11/1973 | Wehr et al. | 271/97 |
| 3,837,639 | 9/1974 | Phillips | 271/105 |
| 4,157,177 | 6/1979 | Strecker | 271/197 |
| 4,268,025 | 5/1981 | Murayoshi | 271/112 |
| 4,269,406 | 5/1981 | Hamlin | 271/108 |
| 4,275,877 | 6/1981 | Silverberg | 271/98 X |
| 4,294,539 | 10/1981 | Spehrley, Jr. | 355/76 |
| 4,306,684 | 12/1981 | Peterson | 239/597 |
| 4,382,593 | 5/1983 | Beran et al. | 271/12 |
| 4,418,905 | 12/1983 | Garavuso | 271/98 |
| 4,451,028 | 5/1984 | Holmes et al. | 271/11 |
| 4,526,359 | 7/1985 | Garavuso | 271/98 X |
| 4,560,158 | 12/1985 | Wilson | 271/94 X |

OTHER PUBLICATIONS

IBM Technical Disclosure Bulletin, vol. 6, No. 2, 1963, pp. 32–33.

*Primary Examiner*—Richard A. Schacher
*Attorney, Agent, or Firm*—William A. Henry, II

[57] ABSTRACT

A top vacuum corrugation feeder employs a vacuum feedhead working in conjunction with an air knife to feed sheets from the top of a stack. The feedhead is valveless and has a vacuum applied thereto during the entire feed cycle in order to increase reliability and decrease minimum feed speed. The top vacuum corrugation feeder includes fluffer jets and vectored auxiliary fluffer jets in order to assist the air knife in separating severely downcurled sheets for feeding.

10 Claims, 8 Drawing Figures

FRONT AIR KNIFE TOP VACUUM CORRUGATION FEEDER

REFERENCE TO RELATED APPLICATIONS

Reference is hereby made to commonly assigned copending applications Ser. No. 795,678, entitled "Front Air Knife Top Vacuum Corrugation Feeder", filed Nov. 6, 1985; Ser. No. 676,441, entitled "Top Vacuum Corrugation Feeder With A Valveless Feedhead", now U.S. Pat. No. 4,589,647, filed Nov. 29, 1984; and Ser. No. 795,580, entitled "Front Air Knife Top Vacuum Corrugation Feeder", Filed Nov. 6, 1985.

BACKGROUND OF THE INVENTION

This invention relates to an electrophotographic printing machine, and more particularly, concerns an improved top vacuum corrugation feeder for such a machine.

Present high speed xerographic copy reproduction machines produce copies at a rate in excess of several thousand copies per hour, therefore, the need for a sheet feeder to feed cut copy sheets to the machine in a rapid,-dependable manner has been recognized to enable full utilization of the reproduction machine's potential copy output. In particular, for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

Since the sheets must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents if the image is against the retard mechanism, it can be smeared or erased. On the other hand, if the image is against the feed belt it smeared through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

In addition, currently existing paper feeders, e.g., forward buckle, reverse buckle, corrugating roll, etc., are very sensitive to coefficients of friction of component materials and to sheet material properties as a whole.

One of the sheet feeders best known for high speed operation is the top vacuum corrugation feeder with front air knife. In this system, a vacuum plenum with a plurality of friction belts arranged to run over the vacuum plenum is placed at the top of a stack of sheets in a supply tray. At the front of the stack, an air knife is used to inject air into the stack to separate the top sheet from the remainder of the stack. In operation, air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In this type of feeding system every operation takes place in succession or serially and therefore the feeding of subsequent sheets cannot be started until the feeding of the previous sheet has been completed. In addition, in this type of system the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a shingle or double feeding of sheets. Also, current top and bottom vacuum corrugation feeders utilize a valved vacuum feedhead, e.g., U.S. Pat. No. 4,269,406 which is included herein by reference. At the appropriate time during the feed cycle the valve is actuated, establishing a flow and hence a negative pressure field over the stack top or bottom if a bottom vacuum corrugation feeder is employed. This field causes the movement of the top sheet(s) to the vacuum feedhead where the sheet is then transported to the takeaway rolls. Once the sheet feed edge is under control of the takeaway rolls, the vacuum is shut off. The trail edge of this sheet exiting the feedhead area is the criteria for again activating the vacuum valve for the next feeding.

PRIOR ART

U.S. Pat. No. 2,979,329 (Cunningham) describes a sheet feeding mechanism useful for both top and bottom feeding of sheets wherein an oscillating vacuum chamber is used to acquire and transport a sheet to be fed. In addition, an air blast is directed to the leading edge of a stack of sheets from which the sheet is to be separated and fed to assist in separating the sheets from the stack.

U.S. Pat. No. 3,424,453 (Halbert) illustrates a vacuum sheet separator feeder with an air knife wherein a plurality of feed belts with holes are transported about a vacuum plenum and pressurized air is delivered to the leading edge of the stack of sheets. This is a bottom sheet feeder.

U.S. Pat. No. 2,895,552 (Pomper et al.) illustrates a vacuum belt transport and stacking device wherein sheets which have been cut from a web are transported from the sheet supply to a sheet stacking tray. Flexible belts perforated at intervals are used to pick up the leading edge of the sheet and release the sheet over the pile for stacking.

U.S. Pat. No. 4,157,177 (Strecker) illustrates another sheet stacker wherein a first belt converyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 4,268,025 (Murayoshi) describes a top sheet feeding apparatus wherein a sheet tray has a vacuum plate above the tray which has a suction hole in its bottom portion. A feed roll in the suction hole transports a sheet to a separating roll and a frictional member in contact with the separating roll.

U.S. Pat. No. 4,418,905 (Garavuso) shows a bottom vacuum corrugation feeding system.

U.S. Pat. No. 4,451,028 (Holmes et al.) discloses a top feed vacuum corrugation feeding system that employs front and back vacuum plenums.

U.S. Pat. Nos. 868,317 (Allen); 1,721,608 (Swart et al.); 1,867,038 (Uphan); 2,224,802 (Spiess); 3,041,067 (Fux et al.); 3,086,771 (Goin et al.); 3,770,266 (Wehr et al.); and 4,328,593 (Beran et al.); all disclose sheet feeders in which a blower appears to be angled at sheets.

U.S. Pat. Nos. 3,182,998 (Peterson) is directed to a conveyor device that includes a belt comprising diamond shaped rubber suction cups.

U.S. Pat. Nos. 3,837,639 (Phillips) and 4,306,684 (Peterson) relate to the use of air nozzles to either separate or maintain sheet separation.

U.S. Pat. No. 3,171,647 (Bishop) describes a suction feed mechanism for cardboard and like blanks that employs a belt which is intermittently driven.

U.S. Pat. No. 3,260,520 (Sugden) is directed to a document handling apparatus that employs a vacuum feed system and a vacuum reverse feed belt adapted to separate doublets.

U.S. Pat. No. 3,614,089 (Van Auken) relates to an automatic document feeder that includes blowers to raise a document up against feed belts for forward transport. Stripper wheels are positioned below the feed belts and adapted to bear against the lower surface of the lowermost document and force it back into the document stack.

U.S. Pat. No. 4,294,539 (Spehrley,Jr.) discloses a document handling system that in FIGS. 5 and 6 shows a single large apertured vacuum belt having smooth grooves for optical uniformity as well as air flow uniformity.

IBM Technical Disclosure Bulletin entitled "Document Feeder and Separator", Vol. 6, No. 2, page 32, 1963 discloses a perforated belt that has a vacuum applied through the perforations in the belt in order to lift documents from a stack for transport. The belt extends over the center of the document stack.

The above-mentioned disclosures are included herein by reference to the extent necessary to practice the present invention.

SUMMARY OF THE INVENTION

It is an object of the present invention to provide an improved sheet separator feeder.

It is an additional object of the present invention to provide an improved sheet feeder that is independent of sheet material properties.

It is a further object of the present invention to provide a sheet separator feeder that has a longer lasting high quality field performance.

It is yet another object of the present invention to provide critical enablers to the fluffing of sheets in a sheet separator feeder in order to improve the feeding of downcurled, stiff sheets.

It is an additional object of the present invention to provide a sheet separator feeder with an improved vacuum feed mechanism belt that enhances sheet acquisition by effectively enlarging the vacuum area, and thereby also increasing the sheet drive out force of the feed belt.

These and other objects are attained with a top sheet feeding apparatus comprising a sheet stack support tray, feedhead means including a vacuum plenum chamber positioned over the front of a stack of sheets when sheets are placed in the tray with the vacuum plenum chamber having a negative pressure applied thereto at all times during a feed cycle, said vacuum plenum chamber having a sheet corrugation means mounted in the center of its bottom surface and perforated knurled feed belts associated with said vacuum plenum chamber to transport the sheets acquired by said vacuum plenum chamber in a forward direction out of the stack support tray; air knife means positioned immediately adjacen the front of said stack of sheets for applying a positive pressure to the sheet stack in order to separate the uppermost sheet from the rest of the stack; said air knife means including fluffer jets, vectored auxiliary fluffer jets and a converging slot jet, and fang gate means adapted to prevent multifeeding of sheets.

For a better understanding of the invention as well as other objects and further features thereof, reference is made to the following drawings and descriptions.

DESCRIPTION OF THE PREFERRED EMBODIMENT

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
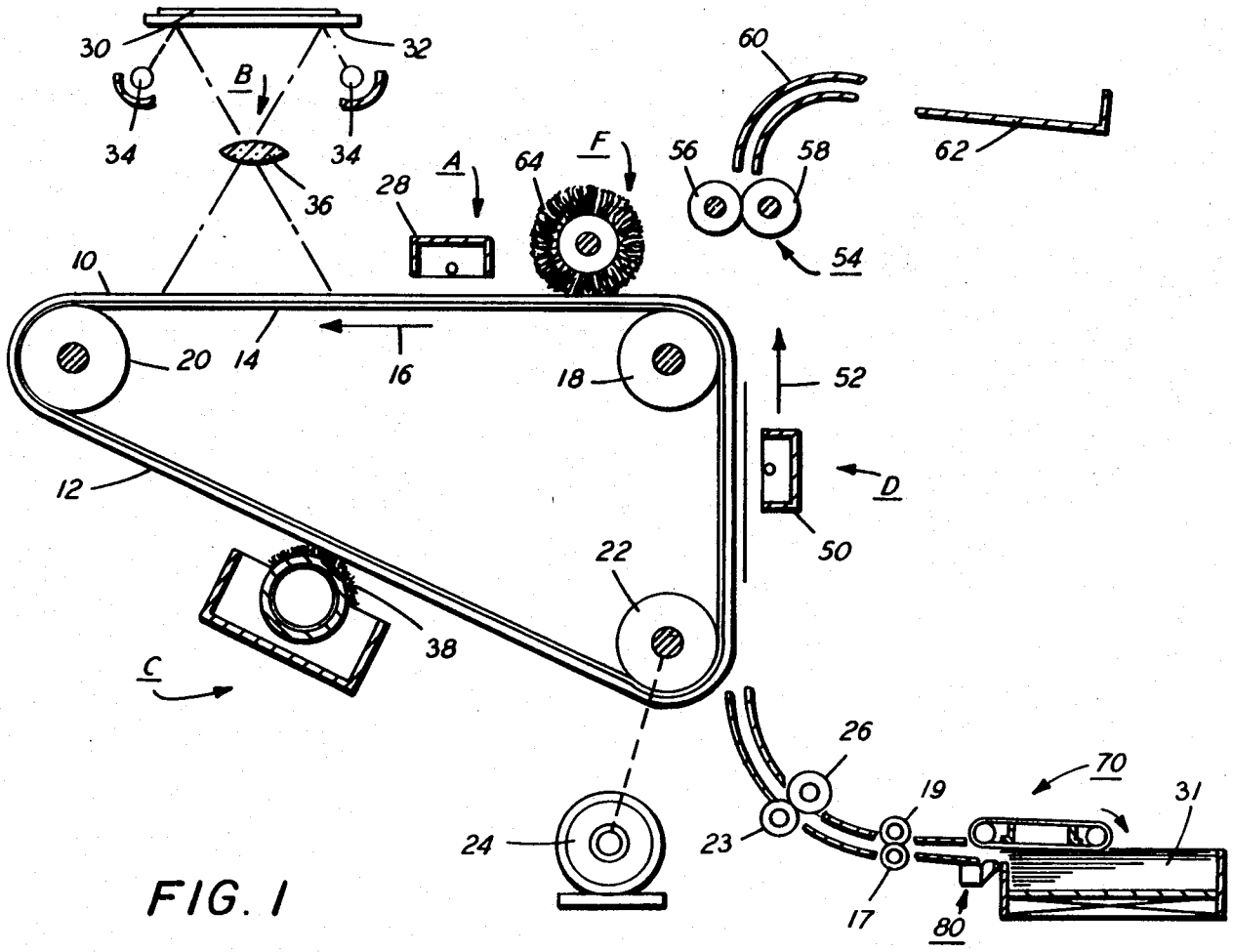
FIG. 1 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the top feed vacuum corrugation feeder method and apparatus of the present invention therein. It will become evident from the following discussion that the sheet feeding system disclosed herein is equally well suited for use in a wide variety of devices and is not necessarily limited to its application to the particular embodiment shown herein. For example, the apparatus of the present invention may be readily employed in nonxerographic environments and substrate transportation is general.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photoconductive surface 12 deposited on a conductive substrate 14. Preferably, photoconductive surface 12 is made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 24 through a belt drive. Motor 24 rotates roler 22 to advance belt 10 in the direction of arrows 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductive surface 12 of the belt 10 to a relatively high, substantially uniform potential.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the information areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet support material is advanced toward transfer station D by top vacuum corrugation feeder 70. Preferably, the feeder includes an air knife 80 which floats a sheet 31 up to where it is grabbed, by the suction force from vacuum plenum 75. A perforated feed belt 71 then forwards the now separated sheet for further processing, i.e., the sheet is directed through rollers 17, 19, 23, and 26 into contact with the photoconductive surface 12 of belt 10 in a timed sequence by suitable conventional means so that the toner powder image developed thereon synchronously contacts the advancing sheet of support material at transfer station D.

Transfer station D includes a corona generating device 50 which sprays ions onto the backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the sheet support material is separated from the photoconductive surface 12 of belt 10, some residual particles remain adhering thereto. These residual particles are removed.from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient to illustrate the general operation of an electrostatographic machine.

Figure 2:
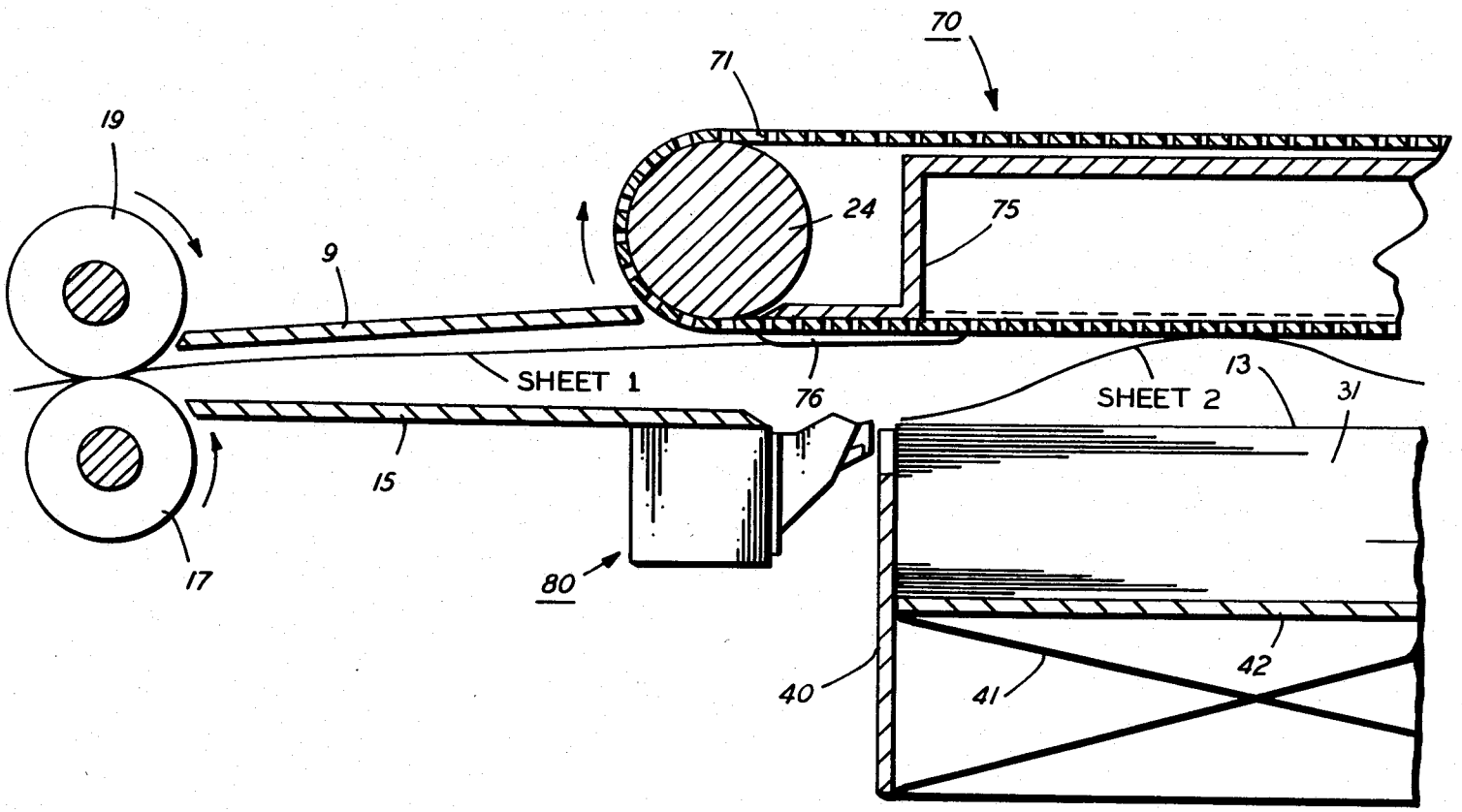
FIG. 2 is an enlarged partial cross-sectional view of the exemplary feeder in FIG. 1 which is employed in accordance with the present invention.
Figure 3:
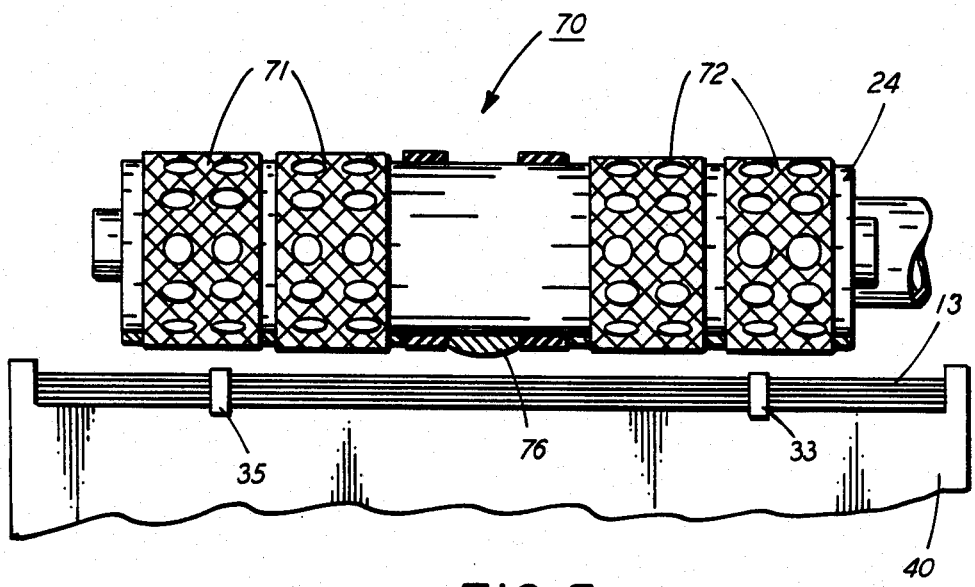
FIG. 3 is a partial front end view of the paper tray shown in FIG. 2.

Referring now to a particular aspect of the present invention, FIGS. 2 and 3 show a system employing the present invention in a copy sheet feeding mode. Alternatively or in addition, the sheet feeder may be mounted for feeding document sheets to the platen of a printing machine. The sheet feeder is provided with a conventional elevator mechanism 41 for raising and lowering either tray 40 or a platform 42 within tray 40. Ordinarily, a drive motor is actuated to move the sheet stack support platform 42 vertically by a stack height sensor positioned above the rear of the stack when the level of sheets relative to the sensor falls below a first predetermined level. The drive motor is deactuated by the stack height sensor when the level of the sheets relative to the sensor is above a predetermined level. In this way, the level of the top sheet in the stack of sheets may be maintained within relatively narrow limits to assure proper sheet separation, acquisition and feeding.

Vacuum corrugation feeder 70 and a vacuum plenum 75 are positioned over the front end of a tray 40 having copy sheets 31 stacked therein. Belts 71 are entrained around drive rollers 24 as well as plenum 75. Belts 71 could be made into a single belt if desired. Perforations 72 in the belts allow a suitable vacuum source (not shown) to apply a vacuum through plenum 75 and belts 71 to acquire sheets 31 from stack 13. Air knife 80 applies a positive pressure to the front of stack 13 to separate the top sheet in the stack and enhance its acquisition by vacuum plenum 75. Corrugation rail 76 is attached or molded into the underside and center of plenum 75 and causes sheets acquired by the vacuum plenum to bend during the corrugation so that if a second sheet is still sticking to the sheet having been acquired by the vacuum plenum, the corrugation will cause the second sheet to detack the fall back into the tray. A sheet captured on belts 71 is forwarded through baffles 9 and 15 and into forwarding drive rollers 17 and 19 for transport to transfer station D. In order to prevent multifeeding from tray 40, a pair of restriction members 33 and 35 are attached to the upper front end of tray 40 and serve to inhibit all sheets other than sheet 1 from leaving the tray. It is also possible to place these restriction members or fangs on the air knife instead of the tray.

In order to improve sheet acquisition, increase reliability and decrease minimum feed speed vacuum plenum 75 is preferably equipped with a negative pressure source that is ON contiuously during the feed cycle, with the only criteria for sheet feeding being that the motion of vacuum feedhead 70 is ceased prior to the trail edge of the acquired sheet exposing all of the vacuum ports. The next sheet is then acquired in a "traveling wave" fashion as shown in FIG. 2. This improved feeding scheme affords a reduction in noise due to the elimination of the valve associated with cutting the vacuum means ON and OFF. Also, increased reliability/decreased minimum feed speed is obtained, i.e., for given minimum required sheet acquisition and separation times the removal of the valve from the vacuum system allows increased available acquisition/separation time per feed cycle and/or lower required minimum feed speeds. In addition, the removal of the valve from the vacuum system increases component reliability since no valve is required to actuate every feed cycle and electrical control is decreased because with no valve required in the vacuum system the required valve component input/output is eliminated. It should be understood that the valveless vacuum feedhead of the present invention is equally adaptable to either bottom or top vacuum corrugation feeders. If one desired, the negative pressure source could be valved, however, in this situation the vacuum valve is turned OFF as soon as the fed sheet arrives at the take away roll and is then turned back ON when the trail edges of the fed sheet passes the lead edge of the stack.

As can be seen in FIG. 2, the ripple in sheet 2 makes for a more reliable feeder since the concavity of the sheet caused by continuously operating vacuum plenum 75 will increase the unbuckling of sheet 3 from sheet 2. Sheet 3 will have a change to settle down against the stack before sheet 2 is fed since air knife 80 has been turned off. Belts 71 are stoped just before sheet 1 uncovers the vacuum plenum completely in order to enhance the dropping of any sheets that are tacked to sheet 2 back down upon the stack and to feed the sheets in time with images produced on the photoreceptor. When a signal is received from a conventional controller to feed another sheet, belts 71 are turned in a clockwise direction to feed sheet 2. Knife 80 is also turned ON and applied air pressured to the front of the stack to insure separation of sheet 2 from any other sheets and assist the vacuum plenum in lifting the front end of the sheet up against corrugation rail 76 which is in additional means of insuring against multi-sheet feeding. Knife 80 may be either left continuously "ON" or valved "ON" - "OFF" during appropriate times in the feed cycle. Lightweight flimsy sheet feeding is enhanced with this method of feeding since sheet 2 is easily adhered to the vacuum plenum while sheet 1 is being fed by transport rollers 17 and 19. Also, gravity will conform the front and rear portions of sheet 2 against the stack while the concavity produced in the sheet by the vacuum plenum remains.

Referring more particularly to FIG. 3, there is disclosed a plurality of feed belts 71 supported for movement on rollers. Spaced within the run of belts 71 there is provided a vacuum plenum 75 having an opening therein adapted for cooperation with perforations 72 in the belts to provide a vacuum for pulling the top sheet in the stack onto the belts 71. The plenum is provided with a centrally located projecting portion 76 so that upon capture of the top sheet in the stack by the belts a corrugation will be produced in the sheet. Thus, the sheet is corrugated in a double valley configuration. The flat surfaces of the vacuum belts on each side of the projecting portion of the vacuum plenum generates a region of maximum stress in the sheet which, varies with the beam strength of the sheet. In the unlikely event more than one sheet is pulled to the belts, the second sheet resists the corrugation action, thus gaps are opened between sheets 1 and 2 which extend to their lead edges. The gaps and channels reduce the vacuum levels between sheets 1 and 2 due to porosity in sheet 1 and provide for entry of the separating air flow of the air knife 80.

By suitable valving and controls, it is desirable to provide a delay between the time the vacuum is applied to pull the document up to the feed belts and the start up of the belts to assure that the top sheet in the stack is captured before belt movement commences and to allow time for the air knife to separate sheet 1 from sheet 2 or any other sheets that were pulled up.

Normally, vacuum feed belts and transport belts are flat, smooth, usually elastomeric, and usually with prepunched holes. These holes, coupled with openings to a vacuum plenum between the belts, serve to transmit a negative pressure to the transported sheet material. This negative pressure causes a normal force to exist between the sheet material and the transport belts with the drive force between the sheet material and belts being proportional to the normal force. The problem with these conventional belts is that the negative pressure field is not uniform between the sheet material and the belts once the sheet material is acquired due to sheet porosity effects. The pressure is very highly negative (sealed post pressure) in the near regions of vacuum holes in the belts but increases quickly to atmospheric pressure as the immediate area of holes is left. This effect reduces the average pressure differential seen by the sheet materials, thereby reducing the drive force. As can be seen from FIG. 3, belts 71 are provided as an answer to this problem and improves the coupling between the sheet materials and the vacuum belts by roughening or knurling the elastomer surface of the belts. As a result, a more uniform vacuum force is applied over the entire sheet area compared to the force localized to the regions of the belt holes with a smooth belt. In effect, roughening the surface of the belts, and using a diamond knurl pattern, allows a more uniform, higher average pressure differential to exist across the sheet material for the same heretofore used sealed port pressure, which increases the drive force. Use of a 0.30" (30 mil) diameter diamond knurl pattern on belts 71 allows 2–3× increase in available drive force for the same sealed port pressure than a conventional flat drive belt. The diamond shaped knurl pattern on belts 71 is also critical because it presents multiple sharp tips that serve to increase direct contact and friction with the sheet material and increase tacking power between the sheet material and belts by allowing the vacuum to flow between the knurls and along the diamond shaped sides of the knurls.

Figure 7A:
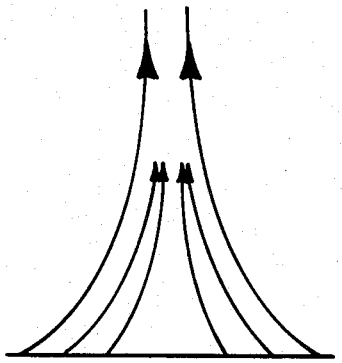
FIGS. 7A and 7B are respective plan and side view illustrations of the converging stream (FIG. 7A) and expanding air streams (FIG. 7B) which result from converging air nozzles in the air knife of FIG. 4.
Figure 7B:
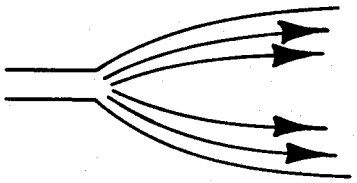
Figure 6:
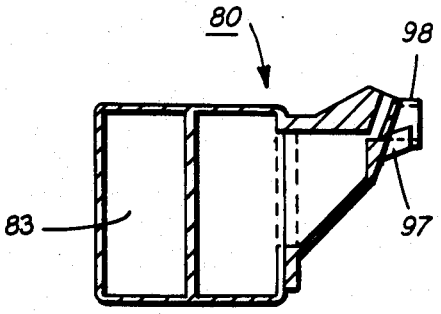
FIG. 6 is a side view of the air knife shown in FIG. 4 taken along line 6—6 of FIG. 4.
Figure 4:
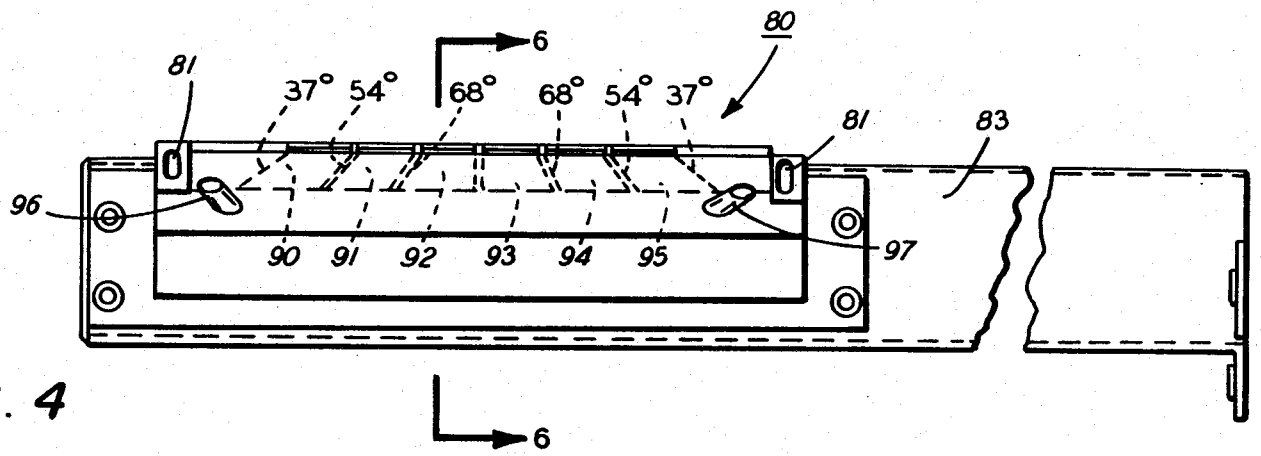
FIG. 4 is a front end view of the air knife according to the present invention.
Figure 5:
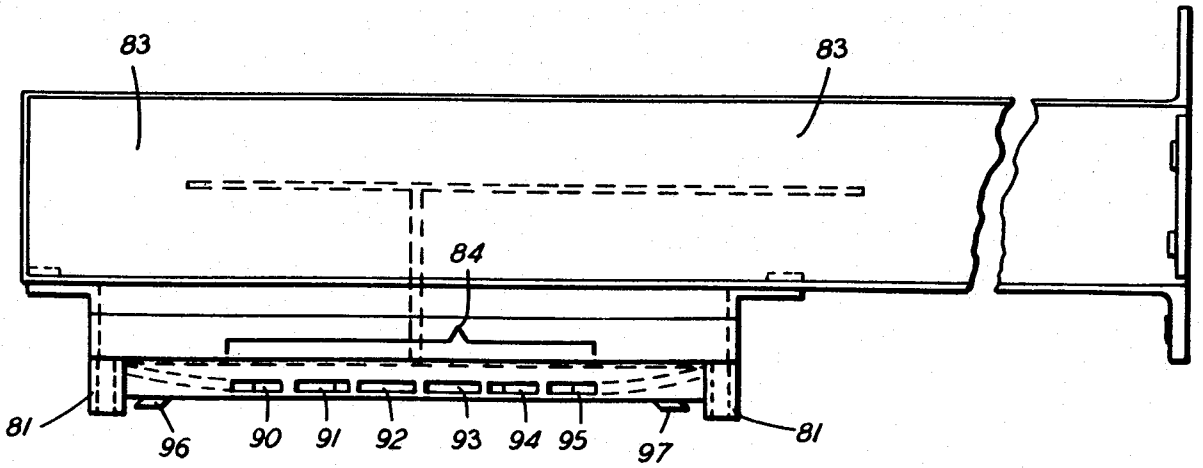
FIG. 5 is a sectional plan view of the air knife shown in FIG. 4.

The improved air knife 80 shown in greater detail in FIGS. 4–6 contains fluffer jets 81, vectored auxiliary fluffer jets 96 and 97 and a converging slot jet 84. The pressurized air plenum 83 and converging slot jet 84 includes an array of separated air nozzles 90–95 that are angled upward with respect to the front edge of the sheet stack The center two nozzles 92 and 93 essentially direct air streams in slightly inwardly directed parallel air streams while the two end sets of nozzles 90, 91 and 94, 95 are angled toward the center of the parallel air streams of nozzles 92 and 93 and provide converging streams of air. Typically, the end nozzles 90 and 91 are slanted at angles of 37 and 54 degrees, respectively. The same holds true for nozzles 94 and 95, that is, nozzle 94 at 54 degrees and nozzle 95 at 37 degrees are slanted inward toward the center of the nozzle group. Nozzles 92 and 93 are angled to direct the main air stream at an angle of 68 degrees respectively. Nozzles 90 through 95 are all arranged in a plane so that the air stream which emerges from the nozzles is essentially planar. As the streams produced from nozzles 90 through 95 emerges from the ends of the nozzles they tend to converge laterally toward the center of the nozzle grouping. This may be more graphically illustrated in FIG. 7A which shows the streams converging laterally. With this contraction of the air stream and the plane of the air stream, there must be an expansion in the direction perpendicular to the air stream. Stated in another manner, while the air stream converges essentially horizontally in an inclined plane, it expands vertically which is graphically illustrated in the side view of the air stream of FIG. 7A which is shown in FIG. 7B. If the air knife is positioned such that the lateral convergence of the air stream and the vertical expansion of the air stream occurs at the center of the lead edge of a stack of sheets and particularly in between the sheet to be separated and the rest of the stack, the vertical pressure between the sheet and the rest of the stack, greatly facilitates separation of the sheet from the remainder of the stack. It has been found that pre-separating sheets from one another ("fluffing") in a stack is essential in the obtainment of suitable feeding reliability for high volume feeders. Stress cases, such as downcurled stiff sheets, however, show a large resistance to "fluffing" when acted upon by sheet separation jets 81 which are essentially perpendicular to the stack lead edge. A cure to this resistance to "fluffing" is incorporated into air knife 80 such that the reliability is greatly enhanced in addition to "fluffing" of the sheets being accomplished and this is by including vectored auxiliary fluffer jets at prescribed angles with reference to the stack edge and location in a manner with reference to the existing main fluffer jets. These additional angled vectored auxiliary fluffer jets 96 and 97 are critical in the proper feeding of stressful paper.

It has been found that optimum results can be obtained when feeding downcurled sheets with the use of vectored jets 96 and 97 if jet 96 as shown in FIG. 6 with respect to a plane parallel to the lead of the stack is at an angle of 56 degrees from the vertical and angled toward one side of the stack lead edge at an angle of 43 degrees with respect to the stack lead edge. Vector jet 97 is optimally positioned at an angle of 56 degrees with respect to the stack lead edge and angled toward the other side of the stack at an angle of 39 degrees.

It should now be apparent that the separation capability of the vacuum corrugation feeder disclosed herein is highly sensitive to air knife pressure against a sheet stack as well as the amount of vacuum pressure directed against the top sheet in the stack. Disclosed herein is a vacuum corrugation feeder that includes a unique air knife assembly, a feedhead assembly that consists of a vacuum plenum combined with knurled feed belts and a sheet corrugator and a fang gate that aids in multifeed prevention. Operation of the vacuum plenum such that it is O all the time without valving allows faster throughput of copy sheets or documents through the apparatus.

In addition to the method and apparatus disclosed above, other modifications and/or additions will readily appear to those skilled in the art upon reading this disclosure and are intended to be encompassed within the invention disclosed and claimed herein.

What is claimed is:

1. A high speed top sheet separator-feeder for separating and forwarding sheets including flimsy sheets and downcurled sheets seriatim from the top of a stack of sheets, comprising a stack tray for supporting a stack of sheets to be fed, endless perforated vacuum belt means extending from a position above a portion of the sheet stack tray to at least the front end of the sheet stack tray for acquiring and advancing the top sheet of the stack, said vacuum belt means including a roughened surface to increase the coupling between a sheet and said vacuum belt means and extending across a support surface having vacuum ports therein for positioning a negative pressure at the back of said vacuum belt means and a corrugation means located on one surface of said support surface that is adapted to corrugate a sheet drawn thereto due to the actuation of said negative pressure so that any sheets initially adhering to the top sheet in the stack of sheets will break away from the top sheet and fall back onto the sheet stack, air knife means positioned in front of the stack tray for applying air pressure to the sheets in the stack tray to separate the top sheet from the next adjacent sheet, said air knife means including separation jets and a converging slot jet for separating the top sheet in the stack from the rest of the stack and vectored auxiliary separation jets for assisting in separating downcurled sheets, vacuum means for applying a continuous and uniform negative pressure to said vacuum ports during the feeding of sheets from the stack tray in order to increase the throughput of said separator-feeder, and gate means adapted to prevent multifeeds from said stack tray.

2. The high speed top sheet separator-feeder of claim 1, wherein said corrugation means comprises a rail positioned centrally of said one surface of said support surface.

3. The high speed top sheet separator-feeder of claim 2, wherein said endless perforated vacuum belt means comprises a plurality of individual belts separated from each other by a predetermined amount.

4. The high speed top sheet separator-feeder of claim 3, wherein said roughened surface of said vacuum belt means comprises raised knurl portions on the top surface of said vacuum belt means configured in a diamond shaped pattern so as to facilitate the ease of flow of negative pressure over the entire top surface of said vacuum belt means and thereby increasing friction between said vacuum belt means and the top sheet of the stack.

5. The high speed top sheet separator-feeder of claim 4, wherein said separation jets are perpendicular to the lead edge of the stack of sheets and said converging slot jets and said vectored separation jets are positioned at acute angles with respect to said separation jets.

6. The high speed top sheets separator-feeder of claim 1, wherein said vacuum belt means comprises at least one belt.

7. A top sheet feeding apparatus comprising a sheet stack support tray, feedhead means including a vacuum plenum chamber positioned over the front of a stack of sheets when sheets are placed in the tray with the vacuum chamber having a negative pressure applied thereto at all times during a feed cycle, said vacuum plenum chamber having a sheet corrugation means mounted in the center of its bottom surface and perforated knurled feed belts associated with said vacuum plenum chamber to transport the sheets acquired by said vacuum plenum chamber in a forward direction out of the stack support tray; air knife means positioned immediately adjacent the front of said stack of sheets for applying a positive pressure to the sheet stack in order to separate the uppermost sheet from the rest of the stack; said air knife means including fluffer jets, vectored auxiliary fluffer jets and a converging slot jet, and fang gate means adapted to prevent multifeeding of sheets.

8. The high speed top sheet separator-feeder of claim 7, wherein said corrugation means comprises a rail positioned centrally of said one surface of said support surface.

9. The high speed top sheet separator-feeder of claim 7, wherein said perforated knurled feed belts comprises raised portions on the top surface of said feed belts configured in a diamond shaped pattern so as to facilitate the ease of flow of negative pressure over the entire top surface of said feed belts and thereby increasing friction between said feed belts and the top sheet of the stack.

10. The high speed top sheet separator-feeder of claim 7, wherein said separation jets are perpendicular to the lead edge of the stack of sheets and said converging slot jet and said vectored auxiliary fluffer jets are positioned at acute angles with respect to said fluffer jets.

* * * * *